US006039454A

United States Patent [19]

Hallgrimsson

[11] Patent Number: 6,039,454

[45] Date of Patent: Mar. 21, 2000

[54] FLAT FLASHLIGHT DEVICE WITH KEY RING ATTACHMENT AND REGISTERABLE AND MATEABE PARTS

[75] Inventor: Bjarki Hallgrimsson, Ottawa, Canada

[73] Assignee: Lumatec Industries, Inc., Austin, Tex.

[21] Appl. No.: 09/060,563

[22] Filed: Apr. 14, 1998

[51] Int. Cl.[7] ..... F21V 33/00; F21L 7/00

[52] U.S. Cl. ..... 362/116; 362/200

[58] Field of Search ..... 362/200, 201, 362/116, 189, 190, 191

[56] References Cited

U.S. PATENT DOCUMENTS

| | | | |
|---|---|---|---|
| 4,122,510 | 10/1978 | Halliday et al. | 362/189 |
| 4,524,409 | 6/1985 | Yakubek | 362/189 |
| 4,739,455 | 4/1988 | Pullman | 362/200 X |
| 4,768,138 | 8/1988 | Leopoldi et al. | 362/189 X |
| 5,070,437 | 12/1991 | Roberts, Sr. | 362/189 X |
| 5,124,898 | 6/1992 | Chabria | 362/189 X |
| 5,317,490 | 5/1994 | Miller | 362/189 X |
| 5,318,177 | 6/1994 | Isacson | 362/116 X |
| 5,457,613 | 10/1995 | Vandenbelt et al. | 362/201 X |
| 5,463,539 | 10/1995 | Vandenbelt et al. | 362/189 |
| 5,895,112 | 4/1999 | Olivit et al. | 362/189 |

*Primary Examiner*—Laura K. Tso

*Attorney, Agent, or Firm*—Flanagan & Flanagan; John K. Flanagan; John R. Flanagan

[57] ABSTRACT

A flat flashlight device includes an inner casing, a light generating bulb having a pair of spaced apart leads and a battery disposed between the leads, a middle folded card insert, an outer protective cover and an end cap. The inner casing includes upper and lower plates attachable to one another and together defining a cavity. The middle folded card insert extends over and substantially overlies the upper and lower plates of the inner casing and the outer protective cover has an open end and defines a pocket receiving the middle folded card insert, bulb, battery and inner casing. The end cap includes top and bottom cap members attachable to one another and together defining a cavity and a hole. The cavity receives portions of the outer protective cover, middle folded card insert and inner casing and in combination with the outer protective cover encloses the middle folded card insert, bulb and battery and inner casing. The hole in the end cap may receive a key ring therethrough. The upper and lower plates of the inner casing together form a recess exposing the bulb at the exterior of the inner casing.

22 Claims, 4 Drawing Sheets

PRESS
BATTERY

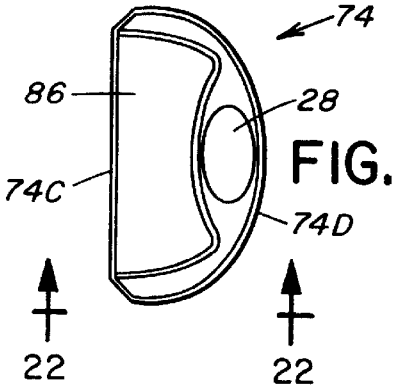
FIG. 21
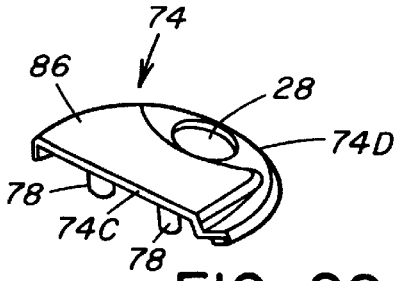
FIG. 20
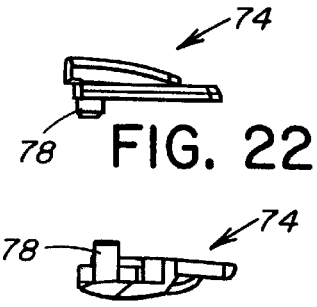
FIG. 22
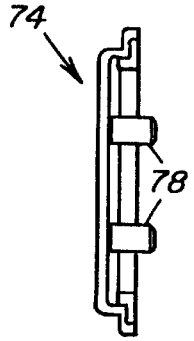
FIG. 25
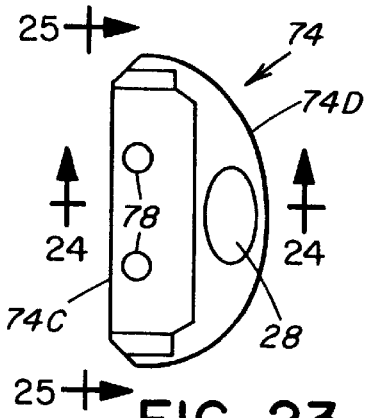
FIG. 23
FIG. 24
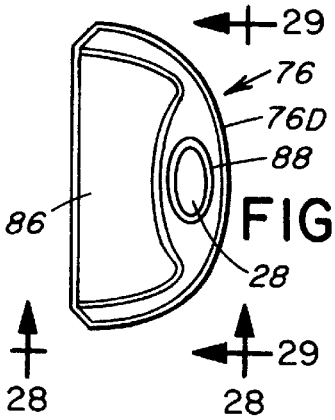
FIG. 27
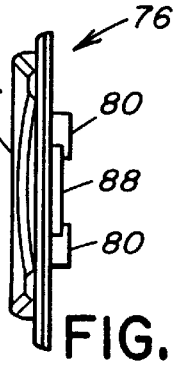
FIG. 29
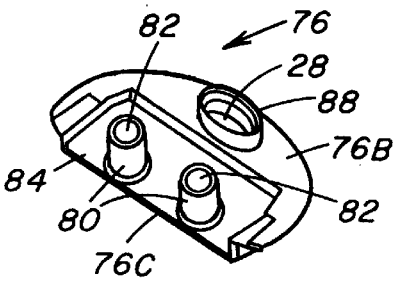
FIG. 26
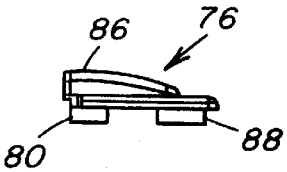
FIG. 28
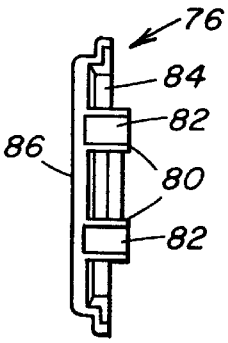
FIG. 31
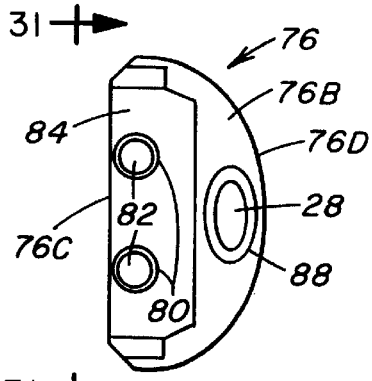
FIG. 30

FLAT FLASHLIGHT DEVICE WITH KEY RING ATTACHMENT AND REGISTERABLE AND MATEABE PARTS

BACKGROUND OF THE INVENTION

1. Field of the Invention

The present invention generally relates to portable lighting devices and, more particularly, is concerned with a flat flashlight device adapted for key ring or chain attachment and having registerable and mateable parts.

2. Description of the Prior Art

Miniature pocket flashlights which can be stored in a pocket or attached to a key chain are known in the prior art. An example of a miniature pocket flashlight is the one disclosed in U.S. Pat. Nos. 4,628,418 and 4,644,451 to Chabria. The Chabria miniature pocket flashlight has a hollow flexible outer case open at opposite ends, a pair of end caps closing the opposite ends of the outer case, a battery receptacle and electrical switch unit disposed in the case which is activated by squeezing the flexible case, and a lamp electrically connected and mounted to the unit and protruding through a hole in one of the end caps on the case (or alternatively the lamp is mounted to a socket in the end cap itself). At least the one end cap is removable in order to replace the lamp and batteries.

The design of the Chabria flashlight embodies at least three major drawbacks. First, the design permits light generated by the lamp to disperse in all possible radial directions from the lamp thus reducing the amount of light projected by the lamp on any one desired location. Second, the design requires that the lamp extend through a hole or from a socket in the end cap of the case. This design requirement leaves the lamp unprotected, exposing it to frequent impacts with extraneous objects while the flashlight is being handled and carried by the user. Such impacts are likely to soon cause breakage of the lamp filament and result in malfunction and premature shortening of the useful life of the lamp. Third, the design requires that one or both of the end caps of the case be frictionally fitted to the ends of the case so as to be readily removable to replace the lamp and batteries. Over time such frictional fits tend to loosen up and allow the parts of the flashlight to come apart. This increases the risk of losing an end cap which would then require the replacement of the flashlight itself.

A thin card-like flashlight device disclosed in U.S. Pat. No. 5,457,613 owned by Lumatec Industries, Inc. of Austin, Tex., and marketed under trademark FLASHCARD, provides a functional and reliable design which overcomes the aforementioned drawbacks of the pocket flashlight design of the Chabria patents. The Lumatec flashlight device provides a package which is relatively thin and flat, has a card-like appearance and handles and feels similar to a credit card with which users are already familiar. The Lumatec flashlight device provides a highly fashionable item as well as providing the lighting function.

In order for the advantages and benefits of the Lumatec flashlight device to be enjoyed by a wider range of users, the inventor(s) herein have perceived a need for a flat flashlight device similar in concept to the prior art Lumatec flashlight device but adapted to accommodate a key ring or chain mode of carrying familiar to users. The inventors herein have also perceived a need for a flat flashlight device easier to assemble than the prior art Lumatec flashlight device.

SUMMARY OF THE INVENTION

The present invention provides a flat flashlight device adapted for key ring or chain attachment and having registerable and mateable parts which are designed to satisfy the aforementioned needs. The flat flashlight device is similar in concept to the prior art Lumatec flashlight device but adapted to accommodate a key ring or chain mode of carrying familiar to users. The device is also designed for manual assemblying and thus easier to assemble than the prior art Lumatec flashlight device.

Accordingly, the present invention is directed to a flashlight device which comprises: (a) an inner light generating module having means for generating light; (b) an outer protective cover having an open end and defining a pocket receiving the inner light generating module; and (c) an end cap having an open end and defining a cavity and a hole. The cavity of the end cap receives portions of the outer protective cover and inner light generating module. The end cap closes the open end of the outer protective cover and in combination with the outer protective cover encloses the inner light generating module. The hole receives a key ring therethrough. The outer protective cover is made of a substantially transparent material. The flashlight device also comprises a middle folded card insert extending over and substantially overlying the inner light generating module.

The inner light generating module includes an inner casing and a light generating means. The inner casing has an upper plate and a lower plate. The upper and lower plates are attachable to one another and together define a cavity. The upper plate has an actuating portion overlying the cavity.

The light generating means includes a bulb, a pair of leads spaced from one another and being connected to and extending from the bulb, and a battery disposed between the leads and at one side is in electrical contact with a first of the leads. The light generating means is disposed within the cavity of the inner casing between the upper and lower plates thereof such that depression of the actuating portion of the upper plate of the inner casing causes a second of the leads to make contact with an opposite side of the battery and thereby complete an electrical circuit between the bulb and battery for generating light.

The upper plate of the inner casing also has an hood portion overlying the bulb. The actuating portion of the upper plate extends from and is mounted in a cantilevered manner to the hood portion. The upper and lower plates of the inner casing together further define a recess exposing the bulb of the light generating means to the exterior of the inner casing. The upper and lower plates of the inner casing also have a plurality of receptacles and a plurality of posts which tightly interference fit into the receptacles for attaching the upper and lower plates to one another.

The upper and lower plates of the inner casing, middle folded card insert and outer protective cover have respective pairs of spaced apart holes which are aligned and registered with one another when the middle folded card insert and inner casing are received within the pocket of the outer protective cover. The end cap is adapted to extend over and mate with the aligned holes and thereby close the open end of the outer protective cover.

More particularly, the end cap includes a top cap member and a bottom cap member. The top and bottom cap members are attachable to one another and together define the aforementioned cavity and hole. The top and bottom cap members also have a pair of interfitting posts and receptacles for disposition through the aligned holes of the upper and lower plates of the inner casing, the middle folded card insert and the outer protective cover for attaching the top and bottom cap members to one another sandwiching the portions of the outer protective cover, middle folded cart insert and inner casing therebetween such that the assembled end cap in combination with the outer protective cover securably encloses the middle folded card insert, light generating means and inner casing.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 20 is a perspective view of a top cap member of an end cap of the device of FIG. 1.

FIG. 21 is a top plan view of the top cap member of FIG. 20.

FIG. 22 is a side elevational view of the top cap member as seen along line 22—22 of FIG. 21.

FIG. 23 is a bottom plan view of the top cap member of FIG. 20.

FIG. 24 is a transverse sectional view of the top cap member taken along line 24—24 of FIG. 23.

FIG. 25 is a front elevational view of the top cap member as seen along line 25—25 of FIG. 23.

FIG. 26 is a perspective view of a bottom cap member of the end cap of the device of FIG. 1.

FIG. 27 is a bottom plan view of the bottom cap member of the end cap of FIG. 26.

FIG. 28 is a side elevational view of the bottom cap member as seen along line 28—28 of FIG. 27.

FIG. 29 is a rear elevational view of the bottom cap member as seen along line 29—29 of FIG. 27.

FIG. 30 is a top plan view of the bottom cap member of the end cap of the device of FIG. 1.

FIG. 31 is a front elevational view of the bottom cap member as seen along line 31—31 of FIG. 30.

DETAILED DESCRIPTION OF THE INVENTION

Figures 1, 2, 3, 4:
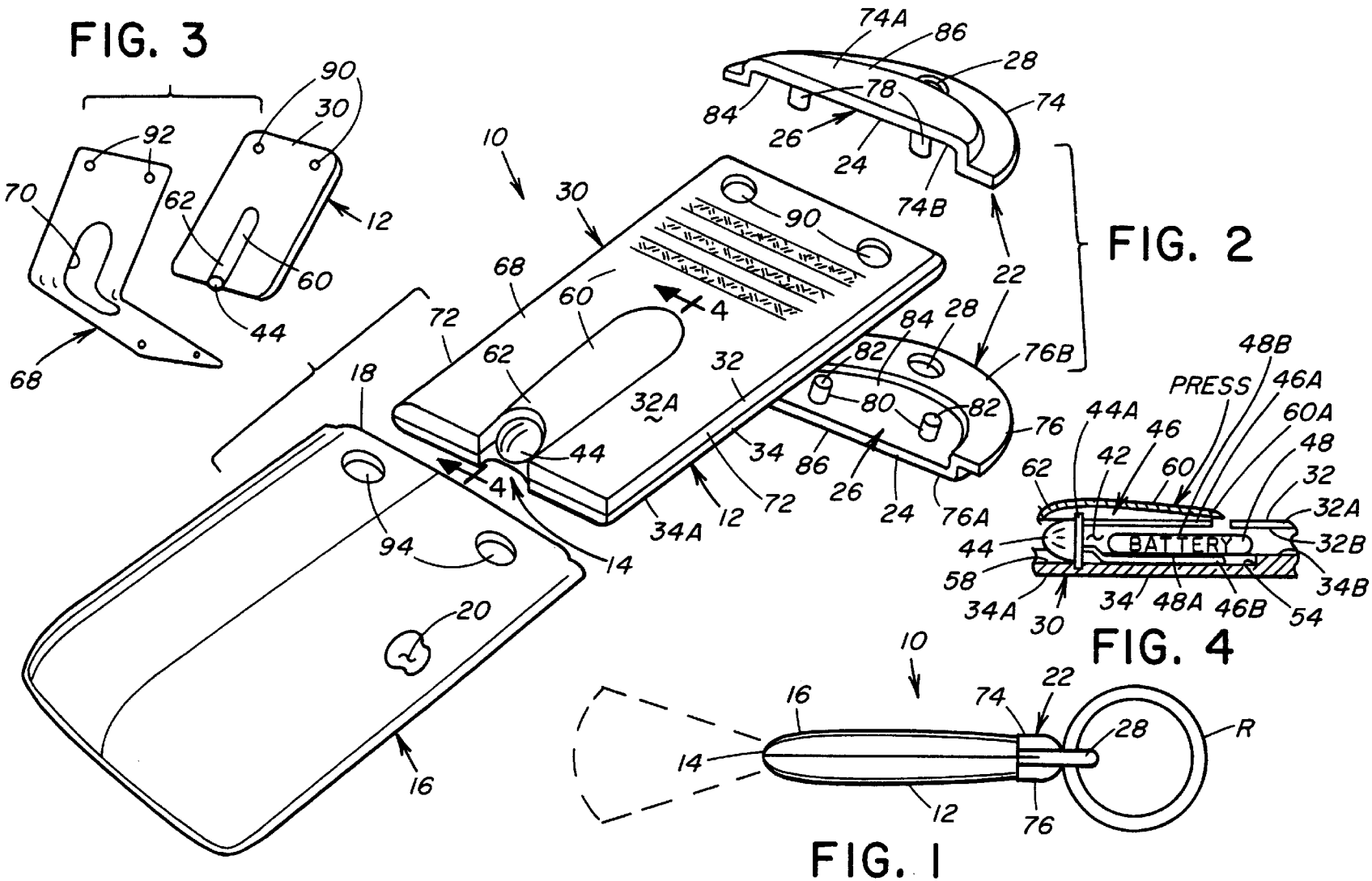
FIG. 1 is a side elevational view of a flat flashlight device of the present invention.
FIG. 2 is an enlarged exploded perspective view of the flat flashlight device of FIG. 1.
FIG. 3 is an exploded perspective view, on a reduced scale, of an inner casing and middle folded card insert of the device of FIG. 1.
FIG. 4 is an enlarged fragmentary longitudinal sectional view of the device taken along line 4—4 of FIG. 2.
Figure 8:
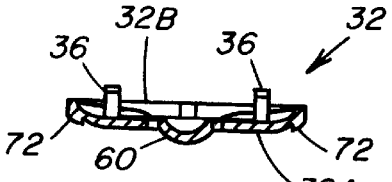
FIG. 8 is a transverse sectional view of the upper plate taken along line 8—8 of FIG. 6.
Figure 5:
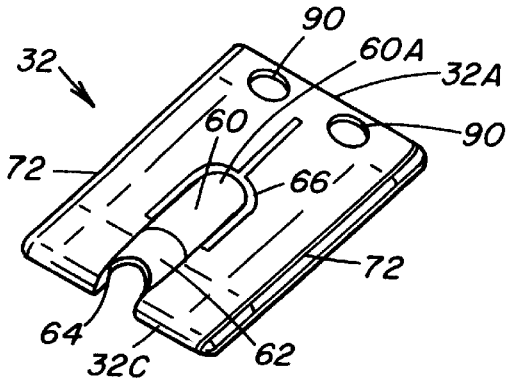
FIG. 5 is a perspective view of an upper plate of an inner casing of the device of FIG. 1.
Figure 6:
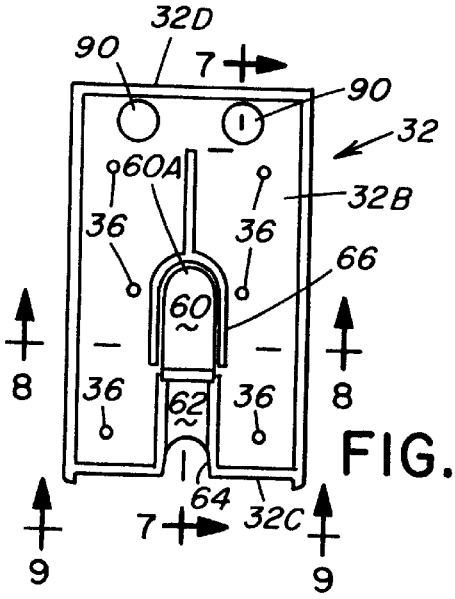
FIG. 6 is a bottom plan view of the upper plate of FIG. 5.
Figure 7:
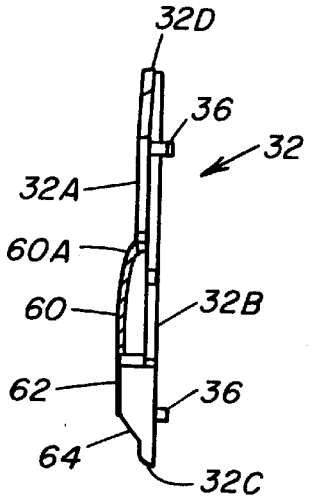
FIG. 7 is a longitudinal sectional view of the upper plate taken along line 7—7 of FIG. 6.
Figure 9:
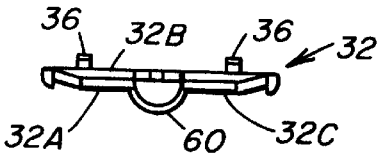
FIG. 9 is a front end elevational view of the upper plate as seen along line 9—9 of FIG. 6.
Figure 11:
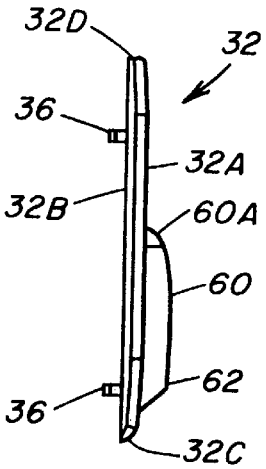
FIG. 11 is a side elevational view of the upper plate as seen along line 11—11 of FIG. 10.
Figure 10:
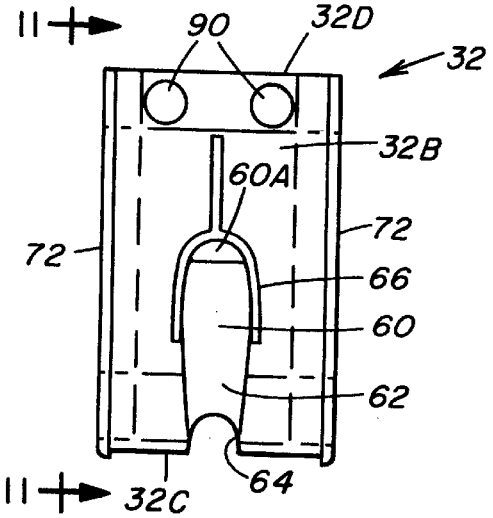
FIG. 10 is a top plan view of the upper plate of FIG. 5.
Figure 15:
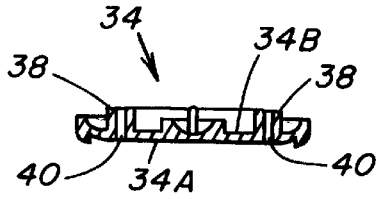
FIG. 15 is a transverse sectional view of the lower plate taken along line 15—15 of FIG. 13.
Figure 12:
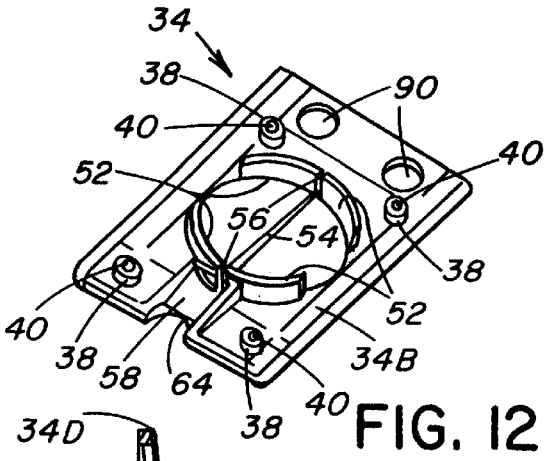
FIG. 12 is a perspective view of a lower plate of the inner casing of the device of FIG. 1.
Figure 13:
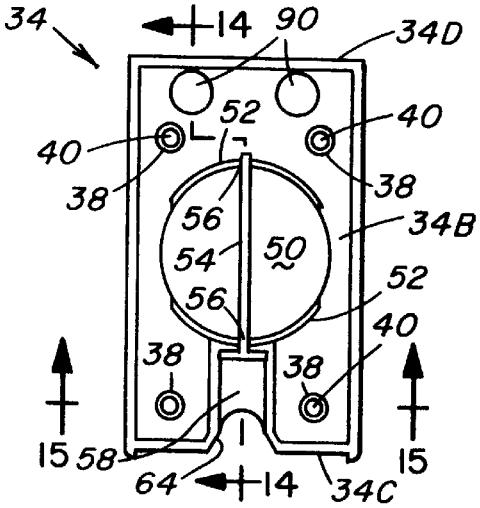
FIG. 13 is a top plan view of the lower plate of FIG. 12.
Figure 14:
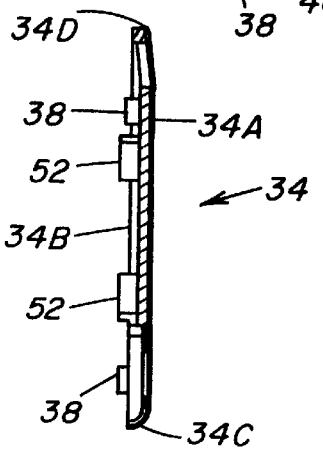
FIG. 14 is a longitudinal sectional view of the lower plate taken along line 14—14 of FIG. 13.
Figure 17:
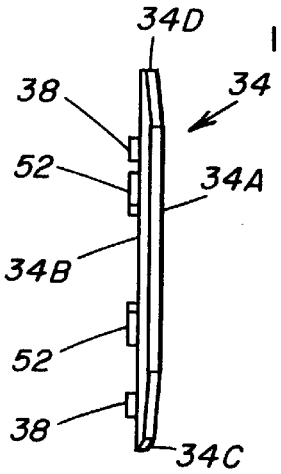
FIG. 17 is a side elevational view of the lower plate as seen along line 17—17 of FIG. 16.
Figure 16:
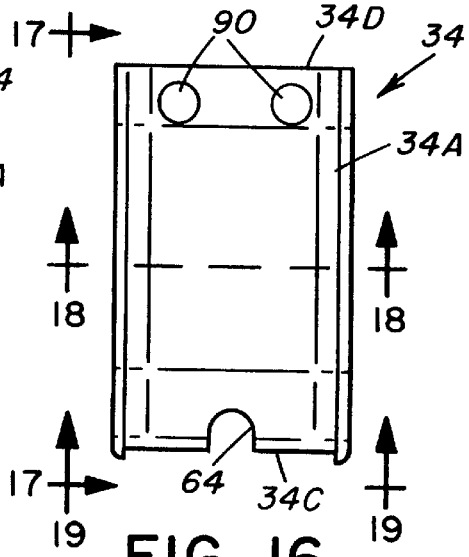
FIG. 16 is a bottom plan view of the lower plate of FIG. 12.
Figure 19:
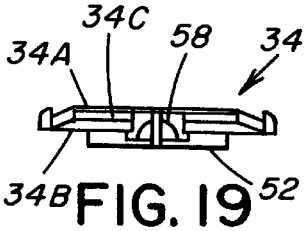
FIG. 19 is a front elevational view of the lower plate as seen along line 19—19 of FIG. 16.
Figure 18:
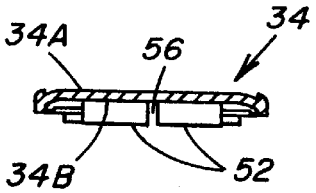
FIG. 18 is transverse sectional view of the lower plate taken along line 18—18 of FIG. 16.

Referring to the drawings and particularly to FIGS. 1 and 2, there is illustrated a flashlight device, generally designated 10, having features in accordance with the principles of the present invention. Basically, the flashlight device 10 includes an inner light generating module 12 having a light generating means 14, an outer protective cover 16 having an open end 18 and defining a pocket 20 receiving the inner light generating module 12, and an end cap 22 having an open end 24 and defining a cavity 26 and a hole 28. The cavity 26 of the end cap 22 receives end portions of the outer protective cover 16 and inner light generating module 12 through the open end 24 of the end cap 22 such that the end cap 22 closes the open end 18 of the outer protective cover 16 and in combination with the outer protective cover 16 encloses the inner light generating module 12. The hole 28 is provided by the end cap 22 for receiving a key ring R or any other suitable and desired element therethrough.

Referring now to FIGS. 1 to 19, the inner light generating module 12 of the device 10 includes an inner casing 30 in addition to the light generating means 14. The inner casing 30 has an upper plate 32 and a lower plate 34. The upper and lower plates 32, 34 respectively are substantially flat and have substantially rectangular configurations, although they may have any other suitable shapes, and have substantially same size. Each of the upper and lower plates 32, 34 has an outer surface 32A, 34A and an inner surface 32B, 34B and opposite ends 32C, 32D and 34C, 34D.

The upper plate 32 has a plurality of posts 36, such as four in number, attached on and extending downwardly from its inner surface 32B, and the lower plate 34 has a plurality of receptacles 38, such as four in number, attached on and extending upwardly from its inner surface 34B. The posts 36 tightly snap on and interference fit into the receptacles 38 for attaching the upper and lower plates 32, 34 to one another. Each post 36 and receptacle 38 is spaced interiorly from and adjacent to a respective corner of the upper and lower plates 32, 34 or in any other suitable location. Each post 36 is preferably hollow and substantially cylindrical in shape, whereas each receptacle 38 likewise has a substantially cylindrical configuration, although the posts 36 and receptacles 38 may have any other suitable shapes. Each hollow receptacle 38 defines a cavity 40 having a diameter slightly greater than a diameter of each post 36 for snugly fitting each post 36 within a respective receptacle 38.

The upper and lower plates together define a cavity 42 in the inner casing 30 for receiving the light generating means 14 of the inner light generating module 12. The light generating means 14 includes a bulb 44, a pair of leads 46 spaced from one another and being connected to and extending from the bulb 44, and a battery 48 disposed between the leads 46 and at one side 48A is in electrical contact with a first one of the leads 46. The light generating means 14 is disposed within the cavity 42 of the inner casing 30 defined between the upper and lower plates 32, 34 thereof. The inner surface 34B of the lower plate 34 has a central seat 50 formed by a pair of opposite arcuate ridges 52. The central seat 50 receives the battery 48 therewithin. The battery 48 preferably is substantially flat and disc-shaped, though may have any other suitable configuration, and, as one example, can be a lithium CR2016 3V battery, though may be of any other suitable type. The battery 48 has a diameter slightly less than the distance between the ridges 52 of the central seat 50 for snugly retaining the battery 48 therewithin. The bulb 44 is of any suitable type. The leads 46 are more particularly an upper lead 46A and a lower lead 46B. The upper lead 46A extends substantially straight away from the bulb 44. The lower lead 46B first extends at an angle away from the bulb 44 and then extends substantially straight therefrom and in parallel relation to the upper lead 46A. In this way, the lower lead 46B constitutes the above-mentioned first one of the leads 46 which extends under the one side 48A of the battery 48 where it is maintained in electrical contact therewith.

The inner surface 34B of the lower plate 34 of the inner casing 30 also defines a longitudinal groove 54 spaced interiorly from the opposite ends 34C, 34D of the lower plate 34 and dividing each of the ridges 52 into halves and such that a gap 56 exists in the middle of each of the ridges 52. The inner surface 34B of the lower plate 34 further defines an end seat 58 between an adjacent one of the ridge 52 and the one end 34C of the lower plate 34. The end seat 58 terminates interiorly from the one end 34C of the lower plate 34. The end seat 58 has a semi-cylindrical configuration, though may have any other suitable shape. The longitudinal groove 54 receives the lower lead 46B and the end seat 58 receives the bulb 44.

The upper plate 32 of the inner casing 30 has an actuating portion 60 overlying the cavity 42 of the inner casing 30 along the top of the cavity 42. The upper plate 32 of the inner casing 30 also has an hood portion 62 overlying the end seat 58 and thus the bulb 44 supported on the end seat 58. The actuating portion 60 of the upper plate 32 extends from and is attached in a cantilevered manner to the hood portion 62. The upper and lower plates 32, 34 of the inner casing 30 at their ends 32C, 34C together form a recess 64 receiving and exposing the bulb 44 of the light generating means 14 to the exterior of the inner casing 30. The recess 64 extends interiorly from the one ends 32C, 34C of the upper and lower plates 32, 34. The cantilevered actuating portion 60 is defined by a slot 66 in the shape of a tuning fork made in the upper plate 32. The hood portion 62 of the upper plate 32 directly opposite from and continuing the shape of the end seat 58 of the lower plate 34 is spaced interiorly from and adjacent to the one end 32C of the upper plate 32. The semi-cylindrical configuration of the actuating portion 60 allows for deformation and deflection thereof in response to the application of finger pressure and ensures that the actuating portion 60 returns to its original position after the finger is removed. The cantilevered actuating portion 60 is substantially horizontal in its original resting position and does not touch the upper lead 46A of the light generating means 14. Depression of the cantilevered actuating portion 60 causes a tip end 60A thereof to contact the upper lead 46A and force it toward and into contact the opposite side 48B of the battery 48 and thereby make electrical contact therewith and complete an electrical circuit between the bulb 44 and battery 48 for generating light. The slot 66 partially surrounds the cantilevered actuating portion 60 so as to enable it to be depressed relative to the rest of the upper plate 32. Sufficient clearance is provided above the upper lead 46A and the actuating portion 60 so that the upper plate 32 will not unintentionally or accidentally engage and move the upper lead 46A into contact with the battery 48 and cause undesired illumination of the bulb 44. The cantilevered actuating portion 60 further defines a transverse recess 68B that provides a seat for receiving a lip or flange 44A on the bulb 44.

The outer protective cover 16 is made of a substantially transparent material, though may be made of any other suitable material. The outer protective cover 16 preferably, but not necessarily, is formed from a single blank of flexible material, such as vinyl plastic, which is folded onto itself and sealed along opposite sides 16A and so as to form the pocket 20. The outer protective cover 16 is substantially rectangular in shape, though may have any other suitable configuration. The outer protective cover 16 has opposite ends 16B, 16C. The one end 16B is closed while the other end 16C is open, as mentioned above, for receives the inner light generating module 12 into the pocket 20.

The device 10 may further include a middle folded card insert 68 which extends over and substantially overlies the inner light generating module 12. The middle folded card insert 68 is also substantially rectangular in shape, though may have any other suitable configuration, and is of a size substantially similar to that of the outer protective cover 16. The middle folded card insert 68 defines an opening 70 which provides open space for accommating the presence of the cantilevered actuating portion 60 of the upper plate 32 of the inner casing 30 and the passage of light from the bulb 44 of the light generating means 14. The upper plate 32 of the inner casing 30 has a pair of raised ribs 72 formed longitudinally along opposite side edges of the outer surface 32A of the upper plate 32 for facilitating the proper positioning of the card insert 68 therebetween.

Referring now to FIGS. 20 to 31, the end cap 22 of the device 10 is formed by a top cap member 74 and a bottom cap member 76. The top and bottom cap members 74, 76 are substantially flat and semi-circular in configuration, though may have any other suitable shape, and have substantially the same size. Each of the top and bottom cap members 74, 76 has an outer surface 74A, 76A and an inner surface 74B, 76B and opposite ends 74C, 74D and 76C, 76D.

The top and bottom cap members 74, 76 of the end cap 22 further have a pair of interfitting posts 78 and a pair of receptacles 80. The posts 78 are attached on and extend downwardly from the inner surface 74B of the top cap member 74. The receptacles 80 are attached on and extend upwardly from the inner surface 76B of the bottom cap member 76. Each post 78 and receptacle 80 is spaced interiorly from and adjacent to the one ends 74C, 76C of the top and bottom cap members 74, 76 and therefore also adjacent to the open end 24 of the end cap 22 or in any other suitable location. The posts 78 and receptacles 80 have substantially cylindrical configurations, though may have any other suitable shape. The receptacles 80 defines cavities 82 having diameters slightly greater than the diameters of the posts 78 for snugly fitting the respective posts 78 within the respective receptacles 80. The posts 78 and receptacles 80 which may be of any suitable size interfit and thereby attach the top and bottom cap members 74, 76 to one another.

Further, each of the top and bottom cap members 74, 76 defines a recess 84 on the inner surfaces 74B, 76B thereof.

Each recess 84 has a substantially rectangular configuration, though may have any other suitable shape, and extends from the end 74C or 76C of either the top or bottom cap member 74 or 76 inwardly such that the recess 84 is spaced from the end 74D or 76D of either the top or bottom cap member 74 or 76. The posts 78 and receptacles 80 are disposed in the recesses 84.

Each of the top and bottom cap members 74, 76 also defines a relief portion 86 on the outer surfaces 74A, 76A thereof. The relief portions 86 are substantially the inverse of the recesses 84. The top and bottom cap members 74, 76 are attachable to one another and together define the cavity 26 and hole 28 of the end cap 22. The cavity 26 of the end cap 22 receives portions of the outer protective cover 16, middle folded card insert 68 and inner casing 30 therein through the open end 24. The end cap 22 in combination with the outer protective cover 16 encloses the middle folded card insert 70, light generating means 14 and inner casing 30. The hole 28 of the end cap 22, as mentioned above, is for receiving a key ring R or any other suitable and desired element therethrough. The hole 28 is defined by both the top and bottom cap members 74, 76. The hole 28 may be of any suitable size and is disposed closer to ends 74D, 76D than to ends 74C, 76C and is not disposed through the recesses 84 or the relief portions 86 of the top and bottom cap members 74, 76. The portion of the hole 28 defined by the bottom cap member 76 has a flange 88 which fits within the portion of the hole 28 defined by the top cap member 74 so as to interfit the portions of the hole 28 to one another.

Lastly, the upper and lower plates 32, 34 of the inner casing 30, the middle folded card insert 68 and the outer protective cover 16 each define a pair of spaced apart holes 90, 92, 94 which are register and align with one another when the middle folded card insert 68 and inner casing 30 are received within the pocket 20 of the outer protective cover 16. The holes 90, 92, 94 are disposed adjacent to the ends 32D, 34D of the upper and lower plates 32, 34 of the inner casing 30 and to ends of each of the middle folded card insert 68 and the outer protective cover 16. The holes 90, 92, 94 have respective diameters which are the same and slightly greater than a diameter of each of the receptacles 80 of the top and bottom cap members 74, 76 of the end cap 22. The posts 78 and receptacles 80 of the top and bottom cap members 74, 76 of the end cap 22 extend through the aligned holes 90, 92, 94 of the upper and lower plates 32, 34 of the inner casing 30, the middle folded card insert 68 and the outer protective cover 16 for attaching the top and bottom cap members 74, 76 to one another and sandwiching the end portions of the outer protective cover 16, middle folded card insert 68 and inner casing 30 therebetween such that the end cap 22 in combination with the outer protective cover 16 securably encloses the middle folded card insert 68, light generating means 14 and inner casing 30.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A flashlight device, comprising:

(a) an inner light generating module having means for generating light, said inner light generating module including an inner casing having an upper plate and a lower plate, said upper and lower plates being attachable to one another and together defining a cavity, said upper plate having an actuating portion overlying said cavity, said means for generating light including a bulb, a pair of leads spaced from one another and being connected to and extending from said bulb and a battery disposed between said leads and at one side in electrical contact with a first of said leads, said light generating means being disposed within said cavity of said inner casing between said upper and lower plates thereof such that depression of said actuating portion of said upper plate of said inner casing causes a second of said leads to make contact with an opposite side of said battery and thereby complete an electrical circuit between said bulb and battery for generating light;

(b) an outer protective cover having an open end and defining a pocket receiving said inner light generating module; and (c) an end cap having an open end and defining a cavity and a hole, said cavity receiving portions of said outer protective cover and inner light generating module, said end cap closing said open end of said outer protective cover and in combination with said outer protective cover enclosing said inner light generating module, said hole for receiving a key ring therethrough.

2. The device of claim 1 wherein said upper plate also has a hood portion overlying said bulb, said actuating portion of said upper plate extending from and mounted in a cantilevered manner to said hood portion.

3. The device of claim 1 wherein said upper and lower plates of said inner casing together further define a recess exposing said bulb of said light generating means exteriorly of said inner casing.

4. A flashlight device, comprising:

(a) an inner light generating module having means for generating light;

(b) an outer protective cover having an open end and defining a pocket receiving said inner light generating module; and (c) an end cap having an open end and defining a cavity and a hole, said cavity receiving portions of said outer protective cover and inner light generating module, said end cap closing said open end of said outer protective cover and in combination with said outer protective cover enclosing said inner light generating module, said hole for receiving a key ring therethrough, said end cap including a top cap member and a bottom cap member, said top and bottom cap members being attachable to one another and together define said cavity and hole.

5. The device of claim 1 wherein said outer protective cover is made of a substantially transparent material.

6. A flashlight device, comprising:

(a) an inner light generating module having means for generating light;

(b) an outer protective cover having an open end and defining a pocket receiving said inner light generating module;

(c) an end cap having an open end and defining a cavity and a hole, said cavity receiving portions of said outer protective cover and inner light generating module, said end cap closing said open end of said outer protective cover and in combination with said outer protective cover enclosing said inner light generating module, said hole for receiving a key ring therethrough; and (d) a middle folded card insert extending over and substantially overlying said inner light generating module.

7. A flashlight device, comprising:

(a) an inner light generating module having means for generating light;

(b) an outer protective cover having an open end and defining a pocket receiving said inner light generating module; and (c) an end cap including a top cap member and a bottom cap member, said top and bottom cap members being attachable to one another and together defining a cavity and a hole, said cavity receiving portions of said outer protective cover and inner light generating module, said end cap closing said open end of said outer protective cover and in combination with said outer protective cover enclosing said inner light generating module, said hole for receiving a key ring therethrough.

8. The device of claim 7 wherein said inner light generating module includes:

an inner casing having an upper plate and a lower plate, said upper and lower plates being attachable to one another and together defining a cavity, said upper plate having an actuating portion; and said means for generating light including a bulb, a pair of leads spaced from one another and being connected to and extending from said bulb, and a battery disposed between said leads and at one side in electrical contact with a first of said leads, said light generating means being disposed within said cavity of said inner casing between said upper and lower plates thereof such that depression of said actuating portion of said upper plate of said inner casing causes a second of said leads to make contact with an opposite side of said battery and thereby complete an electrical circuit between said bulb and battery for generating light.

9. The device of claim 8 wherein said upper plate also has a hood portion overlying said bulb, said actuating portion of said upper plate extending from and mounted in a cantilevered manner to said hood portion.

10. The device of claim 8 wherein said upper and lower plates of said inner casing together further define a recess exposing said bulb of said light generating means exteriorly of said inner casing.

11. The device of claim 8 further comprising:

a middle folded card insert extending over and substantially overlying said inner light generating module.

12. The device of claim 11 wherein said upper plate of said inner casing has a pair of raised ribs formed longitudinally along opposite side edges of said upper plate for positioning said card insert therebetween.

13. The device of claim 7 further comprising:

a middle folded card insert extending over and substantially overlying said inner light generating module.

14. The device of claim 7 wherein said outer protective cover is made of a substantially transparent material.

15. A flashlight device, comprising:

(a) an inner casing including an upper plate and a lower plate, said upper and lower plates being attachable to one another and together defining a cavity, said upper plate having an actuating portion;

(b) means for generating light including a bulb, a pair of leads spaced from one another and being connected to and extending from bulb, and a battery disposed between said leads and at one side in electrical contact with a first of said leads, said light generating means disposed within said cavity of said inner casing between said upper and lower plates thereof such that depression of said actuating portion of said upper plate of said inner casing causes a second of said leads to make contact with an opposite side of said battery and thereby complete an electrical circuit between said bulb and battery for generating light;

(c) a middle folded card insert extending over and substantially overlying said upper and lower plates of said inner casing;

(d) an outer protective cover having an open end and defining a pocket receiving said middle folded card insert, light generating means and inner casing; and (e) an end cap including a top cap member and a bottom cap member, said top and bottom cap members being attachable to one another and together defining a cavity and a hole, said cavity receiving portions of said outer protective cover, middle folded card insert and inner casing, said end cap closing said open end of said outer protective cover and in combination with said outer protective cover enclosing said middle folded card insert, light generating means and inner casing, said hole for receiving a key ring therethrough.

16. The device of claim 15 wherein said upper plate also has a hood portion overlying said bulb, said actuating portion of said upper plate extending from and mounted in a cantilevered manner to said hood portion.

17. The device of claim 15 wherein said upper and lower plates of said inner casing together further define a recess exposing said bulb of said light generating means exteriorly of said inner casing.

18. The device of claim 15 wherein said upper plate of said inner casing has a pair of raised ribs formed longitudinally along opposite side edges of said upper plate for positioning said card insert therebetween.

19. The device of claim 15 wherein said outer protective cover is made of a substantially transparent material.

20. The device of claim 15 wherein said upper and lower plates of said inner casing have a plurality of receptacles and a plurality of posts which tightly interference fit into said receptacles for attaching said upper and lower plates to one another.

21. The device of claim 15 wherein said upper and lower plates of said inner casing, said middle folded card insert and said outer protective cover have respective pairs of spaced apart holes which are aligned and registered with one another when said middle folded card insert and inner casing are received within said pocket of said outer protective cover.

22. The device of claim 21 wherein said top and bottom cap members of said end cap further have a pair of interfitting posts and receptacles for disposition through said aligned holes of said upper and lower plates of said inner casing, said middle folded card insert and said outer protective cover for attaching said top and bottom cap members to one another sandwiching said portions of said outer protective cover, middle folded card insert and inner casing therebetween such that said end cap in combination with said outer protective cover securably encloses said middle folded card insert, light generating means and inner casing.

* * * * *